US006578635B1

(12) United States Patent
Hailey

(10) Patent No.: US 6,578,635 B1
(45) Date of Patent: Jun. 17, 2003

(54) LINING REMOVAL METHOD, SYSTEM AND COMPONENTS THEREOF

(76) Inventor: Charles D. Hailey, 11628 Burning Oaks, Oklahoma City, OK (US) 73150

( * ) Notice: Subject to any disclaimer, the term of this patent is extended or adjusted under 35 U.S.C. 154(b) by 10 days.

(21) Appl. No.: 09/669,182

(22) Filed: Sep. 25, 2000

(51) Int. Cl.[7] ..... E21B 29/00

(52) U.S. Cl. ..... 166/277; 166/297; 166/377; 166/98; 166/99; 166/55.7; 294/86.12

(58) Field of Search ..... 166/377, 277, 166/98, 99, 55, 55.2, 55.3, 55.7, 297; 294/86.12, 86.25, 86.34

(56) References Cited

U.S. PATENT DOCUMENTS

| | | | | |
|---|---|---|---|---|
| 1,739,601 A | | 12/1929 | Marble | 294/86.12 |
| 1,789,993 A | | 1/1931 | Switzer | |
| 2,705,998 A | | 4/1955 | Spang | 164/4 |
| 2,886,369 A | | 5/1959 | Decuir | 294/86.12 |
| 2,915,127 A | | 12/1959 | Abendroth | 166/99 |
| 2,984,302 A | | 5/1961 | Church | 166/98 |
| 3,727,692 A | | 4/1973 | Kinley et al. | 166/297 |
| 3,750,748 A | | 8/1973 | Kinley et al. | 166/277 |
| 3,917,326 A | * | 11/1975 | Grable | 299/8 |
| 5,074,355 A | | 12/1991 | Lennon | 166/55.1 |
| 5,078,546 A | | 1/1992 | Fisk et al. | 405/156 |
| 5,088,553 A | * | 2/1992 | Ralston et al. | 166/55.7 |
| 5,306,101 A | | 4/1994 | Rockower et al. | 405/154 |
| 6,186,234 B1 | * | 2/2001 | Hailey | 166/298 |
| 6,213,210 B1 | * | 4/2001 | Hailey | 166/277 |

* cited by examiner

*Primary Examiner*—William Neuder
(74) *Attorney, Agent, or Firm*—McAfee & Taft

(57) ABSTRACT

A method of removing lining from a tubing in a well includes: reaming at least a portion of the lining material; cutting at least a segment of the lining along a spiral path; engaging the lining for applying a pulling force to the lining; and applying a pulling force to lift the engaged lining out of the tubing. Individual aspects of this also form parts of the present invention, such as a lining reamer, a method of excavating material of a lining in tubing in a well, a spiral-cut cutting tool, a method of spiral cutting lining in a tubing in a well, various inner engagement members to navigate through a bent lining segment in a lining in tubing in a well, a lining removal tool in which the components are rotationally fixed so that all rotate together, a lining removal tool in which an inner engagement member (such as a flat cutting blade or a plurality of resilient but stiff wires) is connected to an inner surface of the outer engagement member, and lining removal methods.

68 Claims, 9 Drawing Sheets

LINING REMOVAL METHOD, SYSTEM AND COMPONENTS THEREOF

BACKGROUND OF THE INVENTION

This invention relates to removing lining from a well and more particularly to methods, systems and components for use in removing plastic lining from metal tubing in a well. One specific application is with polyurethane lining in metal casing cemented in a well.

In constructing a well from which liquid or gas is to be produced, various types of tubing strings can be put in the drilled borehole. One type is typically called "casing." Traditionally this has been a metal tubing having a relatively large inner diameter that allows other tubing strings to be lowered through it. One way to use casing is to lower it into the borehole and then pump cement such that the cement is placed in the annulus between the casing and the wall of the borehole. These operations are performed using well-known techniques.

Another type of tubing string that has been used is a smaller diameter string that is run into the well inside previously installed casing. Such a narrower string might be used to produce oil or gas from the well to the surface, for example. Another example is that such a string might be used to inject substances into the well, such as in a technique referred to as "secondary recovery" in which the injected substance pushes hydrocarbons out of the well (or out another well or other wells).

More recently, a different type of casing has been used in some applications. This type of casing includes the traditional metal tubing, but one lined with plastic. The plastic lining is typically made of a thermoplastic polymer, a non-limiting example of which is polyurethane. With this type of casing, some substances can be produced from or injected into a well without the use of the traditional inner production or injection tubing string referred to in the immediately preceding paragraph. The inner diameter of the lined casing is larger than the inner diameter of the traditional production or injection tubing; therefore, more production or injection per unit of time can be obtained through the lined casing alone than through the narrower traditional production or injection string. That is, higher volumetric flow rates can be obtained through the lined casing. This type of casing has been used, for example, in producing gaseous carbon dioxide from a first well and in injecting it into a second well in a secondary recovery process for driving liquid or gaseous hydrocarbons out of the second well or out of the formation intersected by the second well.

The lined casing application referred to above, in which no separate inner tubing string is used, has advantages over the traditional casing plus production/injection string technique. In addition to the larger flow advantage mentioned above, the lined casing can be used less expensively. Furthermore, the lining is more resistant to corrosion than the metal casing. Such lining can be used to cover damaged casing walls.

Although there are at least the aforementioned advantages, the plastic lining can be damaged during installation and sometimes the metal casing may corrode or deteriorate sufficiently that it needs to be repaired even though it may be covered by the lining. When this damage or deterioration occurs, the lining needs to be pulled out of the outer metal tubing and a new lining installed (and possibly repairs made to damaged metal tubing). Although the outer metal tubing is typically cemented into the well borehole, the lining is retained in the metal tubing by its own outwardly directed force and friction. That is, the lining is not glued or otherwise separately adhered to the metal tubing. Rather, the lining is inserted in known manner into the metal tubing in a radially inwardly compressed state; once installed, the resilient lining (having an uncompressed outer diameter larger than the inner diameter of the metal tubing) expands against the inner surface of the metal tubing so that the lining is held by the radially outward force exerted by the lining and friction between the outer surface of the lining and the inner surface of the tubing. At the mouth of the well, a plastic flange is fused to the upper end of the lining to also provide support. In view of the foregoing reasons why lining sometimes needs to be removed, and since the outer metal tubing is cemented in the borehole, there are the need for a system and method for removing lining from the tubing and the need for components for such system and method.

Although my prior inventions disclosed in U.S. patent application Ser. No. 09/256,021 and U.S. patent application Ser. No. 09/584,954 are directed to satisfying the aforementioned needs, I have developed improvements and enhancements meeting additional needs. Such needs include providing for reaming lining material prior to removal, enabling cooling or lubricating fluid to be conducted during reaming, permitting interchangeability of different outer annular cutters with a reamer, improving the longitudinal cutting of the lining, providing alternative types of separate or integrated spearing devices or inner engagement members adapted to different uses (e.g., navigating through bent lining), and enabling synchronous movement among components.

SUMMARY OF THE INVENTION

The present invention satisfies the aforementioned needs by providing a novel and improved lining removal method, system and components thereof.

The present invention provides for reaming lining material prior to removing it from a tubing in a well. The present invention enables cooling or lubricating fluid to be conducted during reaming. It also permits interchangeability of different outer annular cutters with a reamer.

The present invention provides improved longitudinal cutting of the lining. It particularly provides for the lining to be cut along a spiral path to facilitate removal. Part of the cutting implement passes between the lining and the tubing to assist in removing or loosening the lining from the tubing.

Different functions may need to be performed during removal; therefore, the present invention provides alternative types of separate or integrated spearing devices or inner engagement members adapted to such different uses. For example, one form of novel and improved spearing device facilitates navigating through bent lining within the tubing. As another example, inner engagement elements can be integrated with an outer overshot sleeve to provide an integral engagement and removal structure.

Another form of the invention connects all the components to enable synchronous movement such that all move at least rotationally together.

The present invention provides an overall method of removing lining from a tubing in a well. This method comprises: reaming at least a portion of material within a lining in a tubing in a well; cutting at least a segment of the lining along a spiral path; engaging the lining for applying a pulling force to the lining; and applying a pulling force to lift the engaged lining out of the tubing. Individual aspects of this also form parts of the present invention. Following are examples.

A lining reamer comprises a reamer body having a forward end and a longitudinal passage defined through the reamer body to an opening at the forward end. The forward end includes milling structure to mill plastic material of lining in a tubing in a well such that the milled plastic material forms a strand that passes into the opening and up the passage in the reamer body. Another definition includes an apparatus to excavate lining in a tubing in a well, which apparatus comprises: a reamer body having a forward end; and a cutter ring releasably connected to the reamer body. Preferably the cutter ring is a selected one of a plurality of cutter rings each having the same inner diameter such that each is releasably connectable to the reamer body, but each having a different outer diameter. A related method of excavating material of a lining in tubing in a well comprises: rotating circularly disposed inner cutting elements against a radially inwardly disposed annular portion of the material; rotating circularly disposed outer cutting elements against a radially outwardly disposed annular portion of the material; and rotating reaming elements extending between the inner cutting elements and the outer cutting elements.

A cutting tool to cut lining in tubing in a well comprises a cutter blade including a cutting edge to cut into lining in tubing in a well and further including an angled surface disposed with the cutting edge such that interactive engagement between the lining and the angled surface during cutting by the cutting edge rotates the cutter blade relative to the lining. This is preferably transported into and out of the well on a blade carrier, such as one including a mandrel, a first sleeve disposed on the mandrel, and a second sleeve disposed on the mandrel and connected to the first sleeve such that the first and second sleeves can rotate relative to each other. In this implementation the cutter blade is connected to the second sleeve. A method of cutting lining in a tubing in a well comprises: lowering a cutter blade into a well having a lining in a tubing; engaging the lining with the cutter blade; and moving the engaged cutter blade up the well such that a spiral cut is formed in the lining.

An inner engagement member for a tool for removing plastic lining from tubing in a well comprises a tapered body to navigate through a bent segment in a plastic lining in tubing in a well. The body can include a partially or fully continuously grooved outer surface. It can include longitudinally defined edges such as for reaming. It can terminate at a tip including a chisel element. It can terminate in a removable tip element.

A lining removal tool of the present invention comprises: an inner engagement member (such as one of the above); an outer engagement member; and a coupling connecting the inner and outer engagement members in fixed rotational relation to each other.

Another lining removal tool comprises: an outer engagement member; and an inner engagement member connected to an inner surface of the outer engagement member. The inner engagement member of one such embodiment includes a cutting member attached to the inner surface of the outer engagement member. The inner engagement member of another such embodiment includes a plurality of stiff wires attached to the inner surface of the outer engagement member. Related lining removal methods are also disclosed.

Therefore, from the foregoing, it is a general object of the present invention to provide a novel and improved lining removal method, system and components thereof. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is an elevational view of the cutting tool of FIGS. 4 and 5 showing a cutter blade in an extended, cutting position.

FIG. 9 is a side view of a cutter blade of the cutting tool of FIGS. 4–8.

DETAILED DESCRIPTION OF THE INVENTION

U.S. patent application Ser. No. 09/256,021 and U.S. patent application Ser. No. 09/584,954 are incorporated herein by reference. Although not in all cases so limited, these and the present disclosure particularly pertain to removing plastic lining 2 from a metal tubing or casing 4 partially depicted in FIG. 1. The plastic lining is typically made of a thermoplastic polymer, a non-limiting example of which is polyurethane.

Taken collectively, steps of the present invention provide a method of removing lining from a tubing in a well. These steps comprise: (1) reaming at least a portion of material within a lining in a tubing in a well; (2) cutting at least a segment of the lining along a spiral path; (3) engaging the lining for applying a pulling force to the lining; and (4) applying a pulling force to lift the engaged lining out of the tubing. Other steps can be included as well (e.g., making a horizontal, circumferential cut around the lining to sever one segment of the lining from another segment of the lining).

The fourth-mentioned step above can be performed in any suitable manner, such as those presently known in the art for lifting tools out of a well (e.g., using a derrick and a traveling block or other hoisting apparatus). The first three steps mentioned above can also be suitably implemented, and preferred embodiments are described in the following description of the invention. It is noted that aspects of these respective steps are also individually part of the overall present invention.

Reaming

Figure 1:
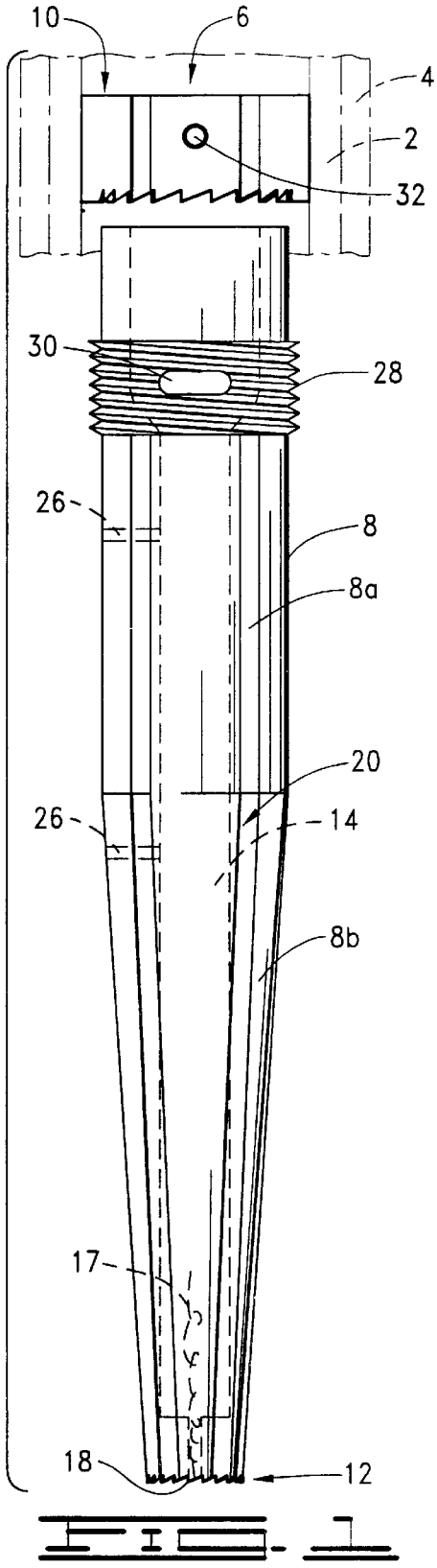
FIG. 1 is an elevational view of a preferred embodiment of a lining excavating apparatus of the present invention.
Figure 2:
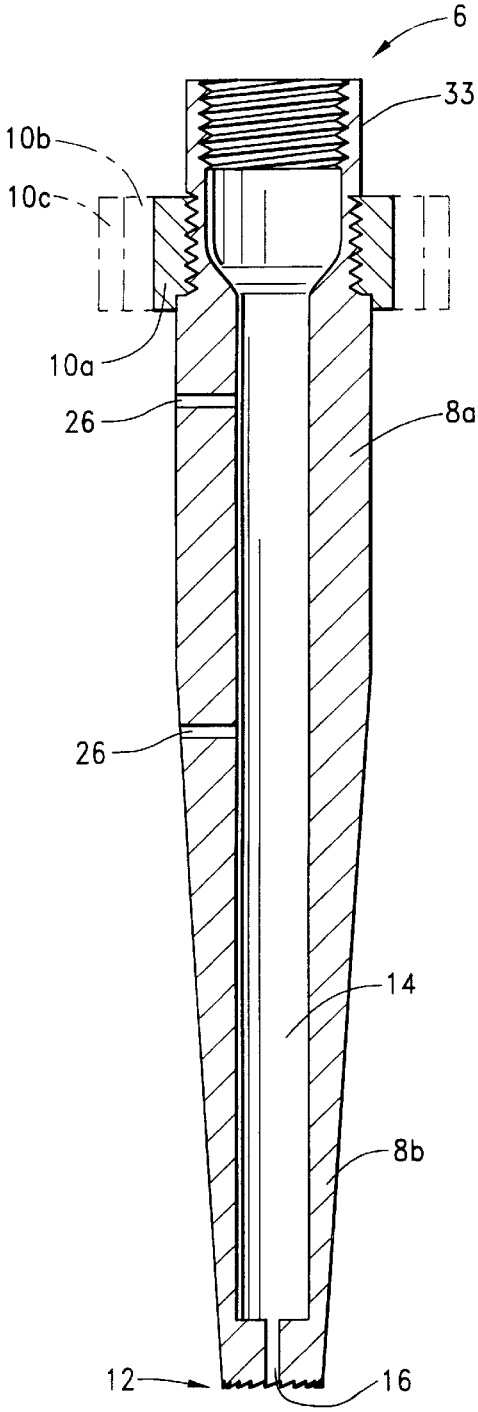
FIG. 2 is a sectioned elevational view of the excavating apparatus having a cutter ring releasably connected to a reamer body so that different sized cutter rings can be used with the reamer body.
Figure 3:
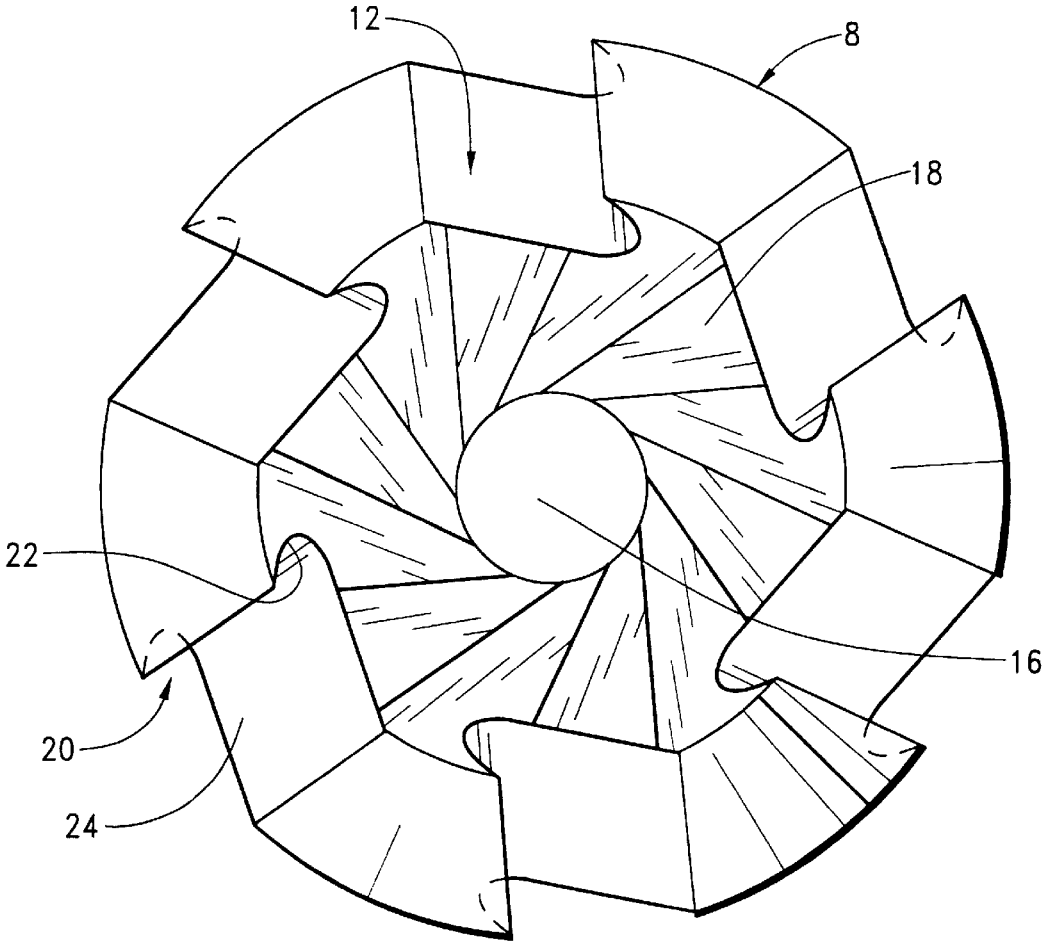
FIG. 3 is a view of the reamer body from below as viewed in the orientation of FIGS. 1 and 2.

A lining reamer 6 with which the aforementioned reaming can be performed has a preferred embodiment which is shown in FIGS. 1–3 and which specifically defines a tapered irrigating reamer mill. The reamer 6 includes a reamer body 8 and one or more cutter rings or collars 10.

The reamer body 8 has a forward end 12 and a longitudinal (specifically axial in the illustrated configuration) passage 14 defined through the reamer body to an opening 16 at the forward end. The forward end 12 includes milling structure to mill plastic material of lining in the tubing in the well such that the milled plastic material forms a typically curled strand 17 that passes into the opening 16 and up the passage 14 in the reamer body 8. The milling structure of the illustrated embodiment includes angled and beveled cutting elements, or teeth, 18. As illustrated in FIG. 3, each tooth 18 is angled or transverse relative to radii of the opening 16. Each tooth 18 is beveled relative to a plane perpendicular to a longitudinal axis of the reamer body 8.

The reamer body 8 more particularly includes a cylindrical body portion 8*a* and a tapered, generally conical body portion 8*b* extending from the cylindrical body portion 8*a* to the forward end 12. The cylindrical body portion 8*a* and the tapered body portion 8*b* have a plurality of longitudinal reamer edges 20. Each of the edges 20 is defined along a respective continuous longitudinal portion of both the cylindrical body portion 8*a* and the tapered body portion 8*b*. Referring to FIG. 3, each edge 20 has a curved slot 22 formed, for example, by ball milling a ledge of the reamer body 8 created by a machined cut-out leaving an adjacent flat surface 24. The reamer body 8 further includes ports 26 (FIGS. 1 and 2) extending laterally from the longitudinal passage 14 to provide exits to the outside of the reamer body 8 when fluid (preferably, a gas or liquid suitable for lubricating or flushing in an oil or gas well) is flowed down from the surface (via a tool or tubing string to which the reamer 6 is connected during use) and through the longitudinal passage 14 during reaming.

The cylindrical body portion 8*a* includes a coupling to receive a selected annular cutter ring 10 (FIGS. 1 and 2). In the illustrated embodiment, the coupling includes a thread 28 defined near an end of the cylindrical portion 8*a* opposite the forward end 12. The thread 28 is preferably a left-hand thread to counter normal clockwise rotation of the tool 6 when put in use (clockwise as viewed from above the hole in which the tool is used). One or more slots 30 is/are defined in the threaded portion as shown in FIG. 1; this receives a set screw through a hole 32 defined in the respective cutter ring 10 to secure the cutter ring to the reamer body after the ring has been screwed onto the reamer body.

The cutter ring 10 includes a thread defined on its inner surface to mate with the thread 28 of the reamer body 8 so that the cutter ring can be releasably connected to the reamer body. FIG. 2 illustrates that cutter rings of different outer diameters, but the same inner diameter, can be used with any one reamer body 8. Three cutter rings 10*a*, 10*b*, 10*c* are represented in FIG. 2. Each has a thread defined thereon to mate with the thread 28 of the reamer body 8, but each has a different outer diameter to accommodate linings of different diameters. Typically, the cutter ring 10 that is selected for use in a particular application is the one with an outer diameter substantially the same as the outer diameter of the lining to be removed because the cutter ring 10 is typically used to cut or mill along a top edge of the lining or lining segment being reamed. As illustrated in FIG. 1, however, the cutter ring 10 can be selected with an outer diameter substantially the same as the inner diameter of the lining 2, which can be useful if milling is needed between the outer diameter of the reamer body 8 and the inner diameter of the lining 2.

The reamer 6 can be used in performing a method of excavating material of a lining in tubing in a well in accordance with the present invention, either alone or in combination with the other steps mentioned above. This method comprises rotating circularly disposed inner cutting elements against a radially inwardly disposed annular portion of the material such that an axial strand of the material is formed. One way of accomplishing this is by connecting a box end 33 of the reamer 6 to a conventional conveying string, lowering the string in conventional manner into the well, and rotating the string in a conventional manner so that the teeth 18 on the lowered reamer 6 turn against the downhole material to be milled.

This reaming further comprises rotating circularly disposed outer cutting elements against a radially outwardly disposed annular portion of the material. This is accomplished by the foregoing procedure of the previous paragraph when one of the rings 10 is selected and attached to the reamer body 6 before it is connected to the conveying string and lowered into the well. As mentioned above, the outer diameter of the ring 10 is selected such that the ring cuts either within the nominal inner diameter of lining 2 or along the wall thickness of the lining itself (i.e., between the nominal inner and outer diameters of the lining in the well) as the string with the attached reamer is rotated.

This reaming also includes rotating reaming elements extending between the inner cutting elements and the outer cutting elements. For the reamer 6 shown in the drawings, this is accomplished in the foregoing procedure by the reaming edges 20 which rotate as the reamer body 8 rotates.

As the reaming or milling occurs against material across the forward end 12 due to the rotated teeth 18, the method further comprises receiving the resulting axial strand 17 of material into the opening 16 disposed inwardly relative to the inner cutting elements 18. This is illustrated in FIG. 1.

The reaming can further comprise flowing a fluid outwardly adjacent the reaming elements. This is performed by pumping (such as in a known manner) a suitable fluid down the tool string, through the channel 14, and out the ports 26 which are preferably staggered at various locations around the circumference of the reamer body 8 so that it is unlikely that all the ports 26 will be blocked at the same time should blockage occur downhole.

Cutting

The milling achieved by the reamer 6 preferably clears or opens a passage within the lining 2 through which a cutting tool of the present invention can be moved. Such a cutting tool can be of any suitable design, including the disclosure of my prior applications incorporated herein; however, the present invention also provides a new cutting tool to cut lining in the tubing in a well and, specifically, to cut it in a spiral pattern. This is achieved in the illustrated embodiment using a cutter blade having a cutting edge to cut into the lining in the tubing in the well and further having an angled surface disposed with the cutting edge such that interactive engagement between the lining and the angled surface during cutting by the cutting edge rotates the cutter blade relative to the lining. The cutter blade of the illustrated embodiment is used with a blade carrier, the illustrated particular implementation of which will be described with reference to FIGS. 4–8. A particular implementation of the cutter blade will then be described with reference to FIGS. 9–11.

The blade carrier of FIGS 4–8 is generally identified by the reference number 34. It includes a solid cylindrical mandrel 36 which has a longitudinal ramped groove 38 (FIG. 4) defined therein near one end to receive illustrated cutter blade 40.

The blade carrier 34 also includes a first cylindrical sleeve 42 disposed on the mandrel 36. The first sleeve 42 has a slot 44 defined therein to receive a pin 46 extending from the mandrel 36. The slot 44 has a long longitudinal section 44*a*, a transverse or circumferential section 44*b* extending from one end of the section 44*a*, and a short longitudinal section 44*c* extending from the section 44*b*opposite the section 44*a*.

Figure 8:
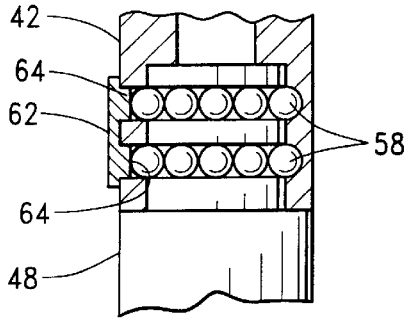
FIG. 8 is a sectioned elevational view of the coupling when joined and retained by ball bearings.
Figure 8:
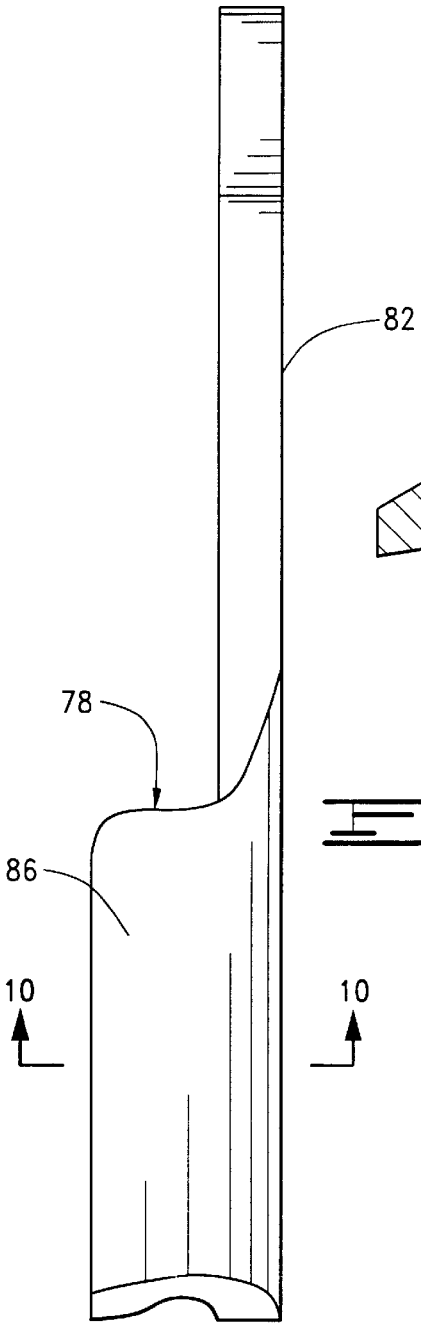

The blade carrier further includes a second cylindrical sleeve 48 disposed on the mandrel 36 and connected to the first sleeve 42 such that the first and second sleeves can rotate relative to each other. In the illustrated implementation, and referring in more detail to FIGS. 7 and 8, the first and second sleeves 42, 48 include mating ends 50, 52, respectively, defining circular tracks 54, 56 having bearings 58 disposed therein such that the second sleeve 48, the cutter blade 40 connected thereto and received in the ramped groove 38 of the mandrel 36, and the mandrel 36 are rotatable relative to the first sleeve 42. In the illustrated embodiment the extent of this rotation is limited by the distance of travel of the pin 46 in the slot section 44*b*. Holes 60 are defined through the side wall of the sleeve 42 so that the bearings can be inserted into the tracks 54, 56 after the end 52 is inserted into the end 50 as illustrated in FIG. 8. After the bearings 58 are installed, the sleeves 42, 48 are thereby secured together and a plate 62 is bolted or otherwise suitably connected to the body of the sleeve 42 to retain the bearings in the tracks. Preferably protuberances 64 extend from the plate 62 to prevent the bearings 58 from leaving their respective track sufficiently to bind the rotational action between the two sleeves 42, 48. In one implementation, twenty-three ball bearings are used in each track.

The blade carrier 34 further comprises a plurality of resilient stabilizers 66 connected to the first sleeve 42 such that the stabilizers 66 engage the inner surface of the lining when the cutting tool is disposed therein. A solid stabilizer pad or shoe 68 is connected (e.g., by welding) to the sleeve 48 to provide support against the lining material when the cutter blade 40 is extended in cutting mode.

The cutter blade 40 is pivotally connected to the blade carrier by a pin (not shown) disposed in holes 70, 72 (FIG. 4) formed in the sleeve 48 adjacent a slot 73 formed in the sleeve 48 to receive the blade 40. The blade 40 is retained in a closed, non-operating position by two balls (not shown) disposed in holes 74, 76; the balls engage opposite sides of the blade to provide frictional retention.

Figure 10:
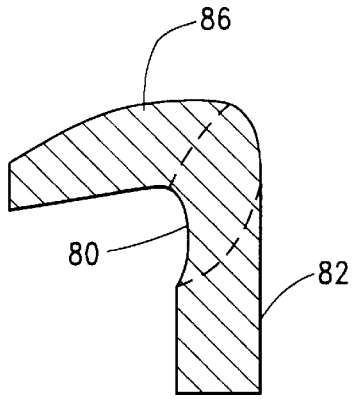
FIG. 10 is a sectional view of the cutter blade taken along line 10—10 in FIG. 9.
Figure 11:
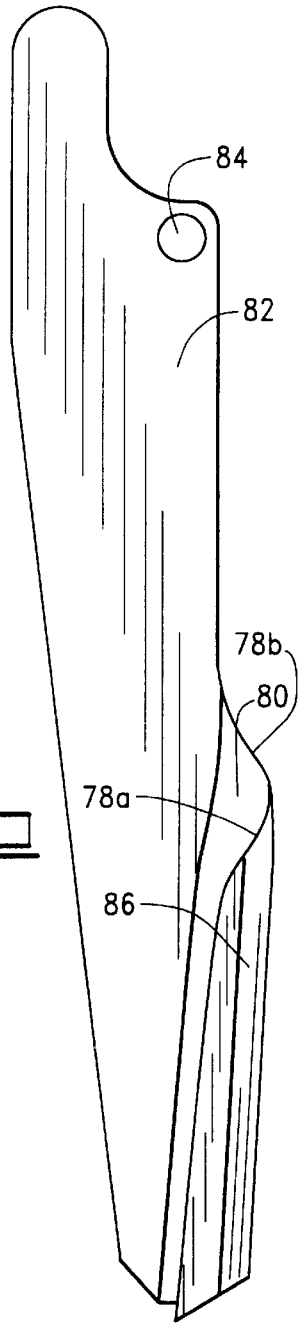
FIG. 11 is another side view of the cutter blade of FIGS. 9 and 10.

Referring to FIGS. 9–11, the blade 40 of the illustrated embodiment includes cutting edge 78 to cut into the lining in the tubing in the well. Angled surface 80 extends such that interactive engagement between the lining and the angled surface during cutting by the cutting edge rotates the blade (and the blade carrier in the illustrated embodiment) relative to the lining 2.

The cutter blade 40 includes a longitudinal shank 82 having a hole 84 which receives the aforementioned mounting pin to pivotally connect the blade 40 to the blade carrier 34. A wedge 86 extends laterally from the shank 82 such that the angled surface 80 is defined between the shank 82 and the wedge 86. The wedge 86 includes a portion 78*a* of the cutting edge 78 at a position such that the wedge 86 passes between the lining 2 and the tubing 4 after the cutting edge portion 78*a* cuts through the lining. As the cutting tool is pulled upwardly, a cutting edge portion 78*b* at the leading edge of the angled surface 80 cuts the lining, and the cut lining 2 and angled surface 80 interactively engage to rotate the blade and blade carrier relative to the lining. The wedge 86 is wide enough to provide stability during cutting, and it provides enough clearance between it and the sleeve 48 to permit a portion of the cut lining to pass between the wedge and the sleeve 48.

Figure 4:
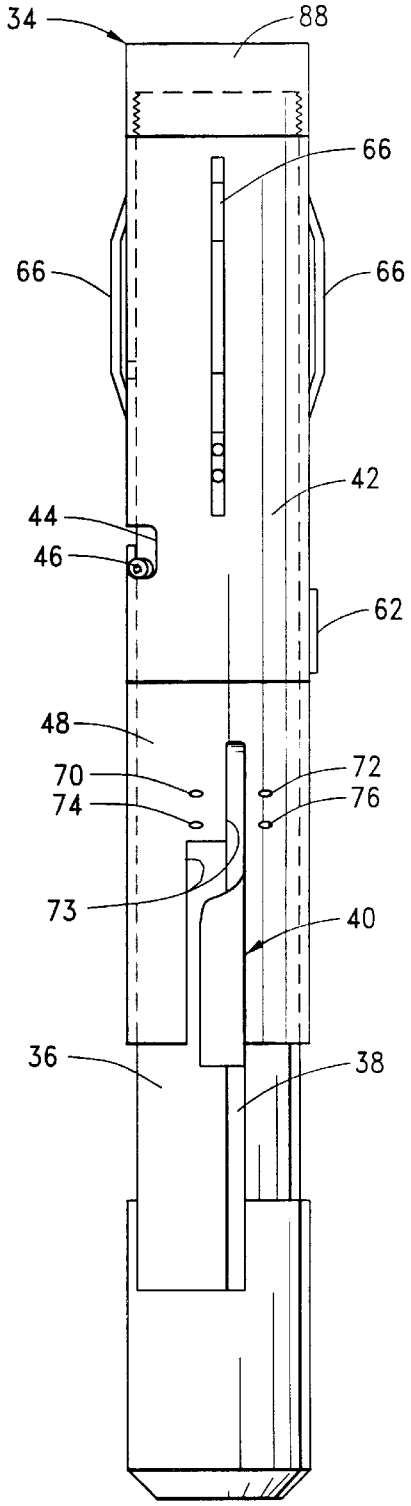
FIG. 4 is an elevational view of a preferred embodiment of a cutting tool of the present invention.
Figure 5:
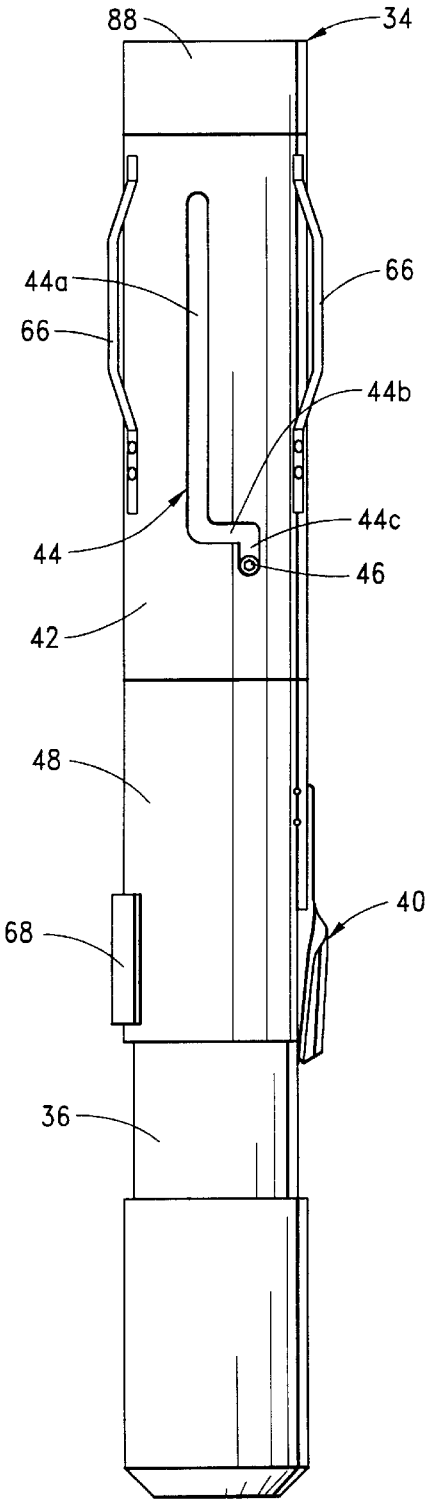
FIG. 5 is another elevational view of the cutting tool shown in FIG. 4.
Figure 5:
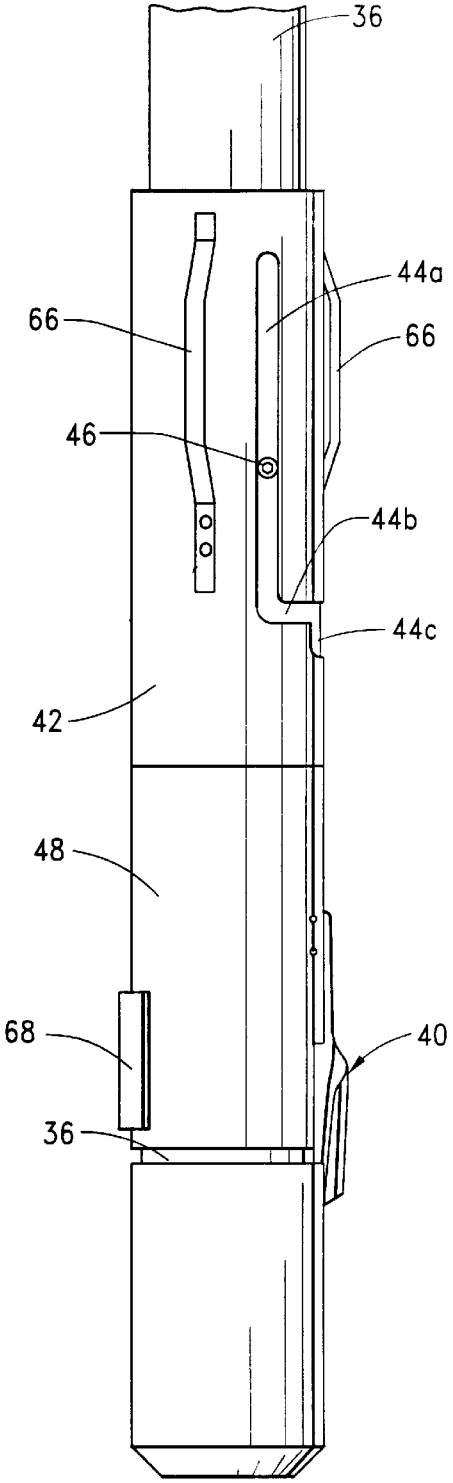
Figure 7:
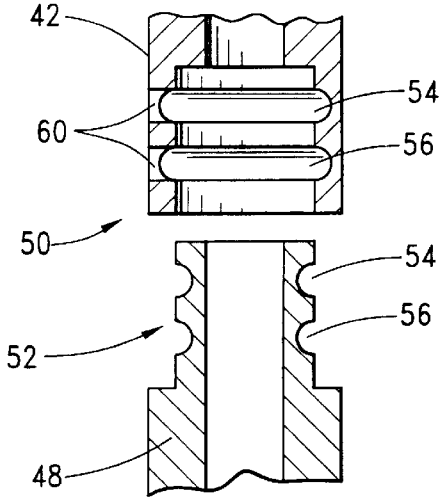
FIG. 7 is a sectioned elevational view of a coupling structure between two outer sleeves of the cutting tool of FIGS. 4–6.

The wedge 86 is narrowest at its upper end coincident with the cutting edge section 78*a*, and it has its thickest part at its lower end. The angled surface 80 has its upper end coincident with the cutting edge section 78*b* and its lower end at the lower end of the blade. The longitudinal wall of the blade adjacent the surface 80 tapers from a thicker lower end to a narrower upper end that terminates at the cutting edge portion 78*b*. "Upper" and "lower" are defined as oriented in FIGS. 9 and 11 and as positioned in the well in an orientation as illustrated in FIGS. 4–6.

The cutter tool can be used to perform a method of cutting lining in tubing in a well in accordance with the present invention. This method can be used in the overall method of the present invention described first above, or it can be used apart. The method comprises lowering a cutter blade into a well having a lining in a tubing. With the illustrated tool, this can be performed by connecting the cutter tool of FIGS. 4–11 to a conveyor string that can be lowered into and lifted from the well, such as the type used with the reamer tool described above. Connection to such string is by threaded coupling at a connector sub 88 connected to or formed with the mandrel 36.

The cutting method of this implementation also comprises engaging the lining 2 with the cutter blade 40. To do this with the illustrated cutter tool, the conveyor string is lifted (such as in conventional manner) to raise the mandrel 36, and the pin 46, relative to the slot section 44*c* in the sleeve 42 (the sleeve 42 remains relatively stationary in the well because of the frictional engagement between the stabilizer members 66 and the wall of the lining). The conveyor string is then rotated (again such as in a conventional manner) clockwise (looking down from above) to move the pin 46 along the short slot segment 44*b* which is transverse to the longitudinal segments of the slot 44. During this rotational movement, the sleeve 48 also rotates relative to the sleeve 42 because the blade 40, pinned to the sleeve 48, is locked with the mandrel 36 by the portion of the blade in the ramped groove 38 in the mandrel 36. The conveyor string is then further lifted to move the mandrel 36 up relative to the sleeves 42, 48 to a position such as illustrated in FIG. 6. As this movement occurs, the blade 40 is pushed outwardly by the decreasing depth of the ramp in the groove 38 engaging the blade 40. The blade 40 is still relatively locked rotationally with the mandrel 36, but the blade is then in its extended operational position.

The cutting method using this particular tool then further comprises moving the engaged cutter blade 40 up the well such that a spiral cut is formed in the lining. This is accomplished by still further lifting of the conveyor string, whereupon the extended blade 40 slices the wall of the lining. As this occurs, part of the sliced wall of the lining 2 passes inside (i.e., toward the sleeve 48) the wedge 86 of the cutter blade 40 such that the wedge is between this portion of the lining and the wall of the tubing 4; this separates or pulls the lining 2 from the tubing 4. Furthermore, the edge of this portion of the cut lining engages the angled surface 80 of the blade 40. This applies a force that rotates the blade (and the entire tool string which is rotationally fixed therewith by the blade 40 in the groove 38 of the mandrel 36 and by the pin 46 in the slot section 44*a*) relative to the lining, thereby creating a spiral cut in the lining. In a particular implementation, about three revolutions of the tool string occur as the tool is longitudinally pulled through a distance equal to about one length of pipe (per "joint").

Engaging

Once the lining has been cut or otherwise prepared for removal, it is engaged in a suitable manner preparatory to pulling it out of the well. Although the incorporated prior applications disclose suitable engagement techniques which can be used in the present overall invention, other engagement members and apparatus are also provided by the present invention. Three new inner engagement members will be described with reference to FIGS. 12–15, and these can be used in, for example, either of two new lining removal tools which will be described with reference to FIGS. 16 and 17. Two other removal tools will be described with reference to FIGS. 18–20.

Each of the three inner engagement members shown in FIGS. 12–15 comprises a tapered body. The embodiments shown in these drawings include a cylindrical portion and a tapered portion, both of which are adapted to engage an inner surface of the plastic lining.

Figure 12:
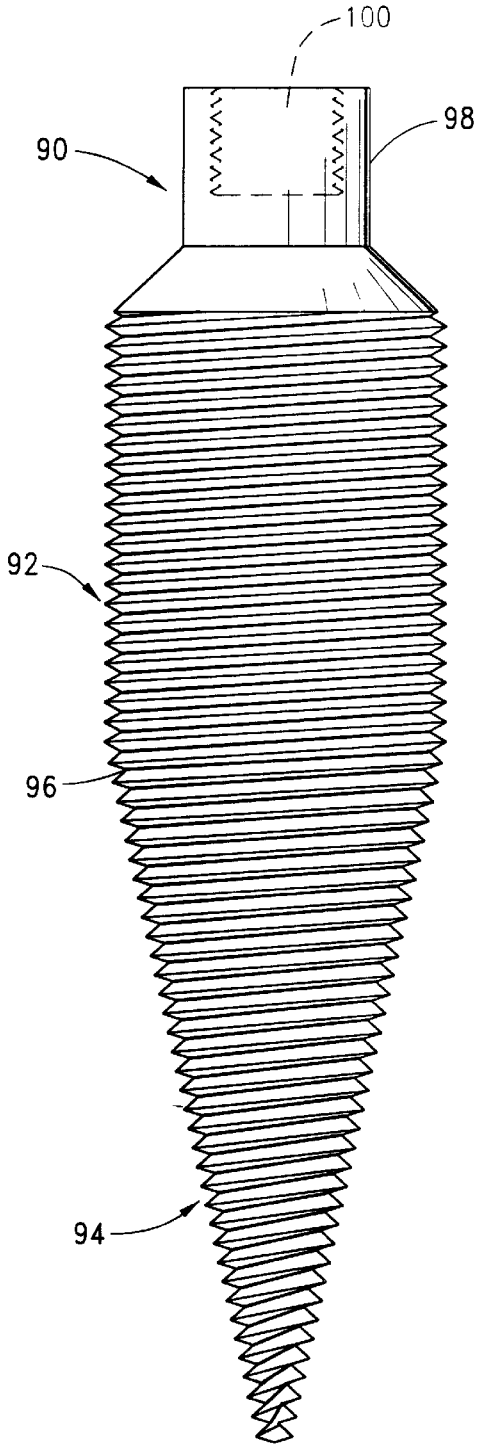
FIG. 12 is an elevational view of a preferred embodiment of an inner engagement member of the present invention.

In the embodiment of FIG. 12, inner engagement member, or spear, 90 has cylindrical portion 92 and conically tapered portion 94. Both of these axially adjoin as shown in the drawing and include a continuously grooved or threaded outer surface 96. A neck portion 98 has a threaded cavity 100 with which to connect to apparatus by which the inner engagement member 90 is carried into and out of the well.

Figure 13:
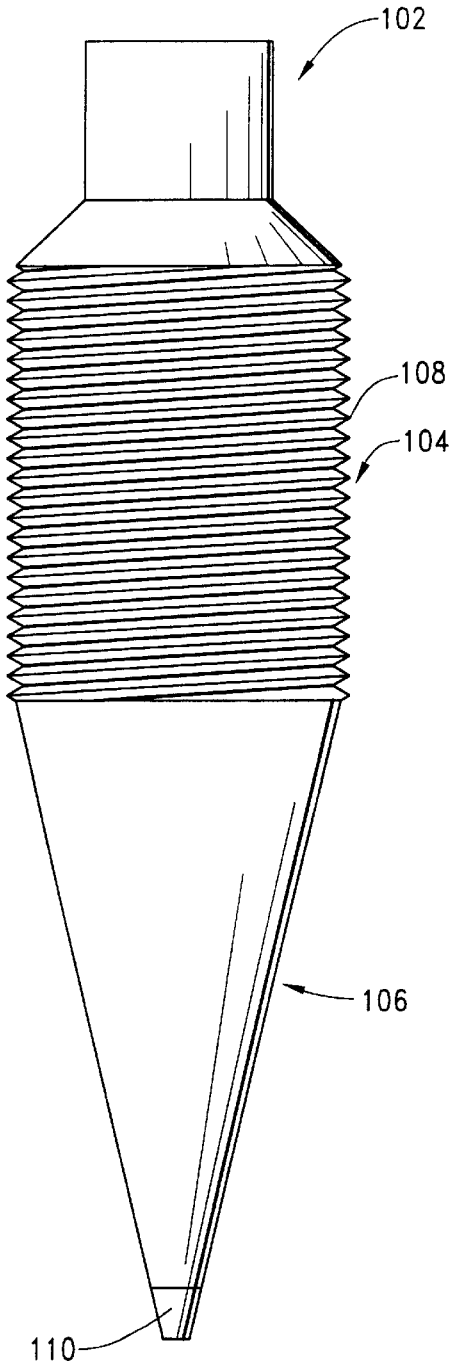
FIG. 13 is an elevational view of another preferred embodiment of an inner engagement member of the present invention.

In the embodiment of FIG. 13, inner engagement member 102 includes cylindrical portion 104 and conically tapered portion 106 as in the member of FIG. 12; however, in the tool of FIG. 13, only the cylindrical portion 104 includes a circumferentially grooved or threaded outer surface 108. Additionally, the tapered portion 106 of the inner engagement member 102 terminates in a removable tip element 110. In the drawing, this tip has a hex-shaped recess to receive a tool to screw or unscrew the tip 110 relative to a threaded receptacle in the tapered portion 106. This tip can be removed and replaced with, for example, an eye element (not shown) to which a chain or other lifting device can be attached to lift something out of the well, for example.

Figure 14:
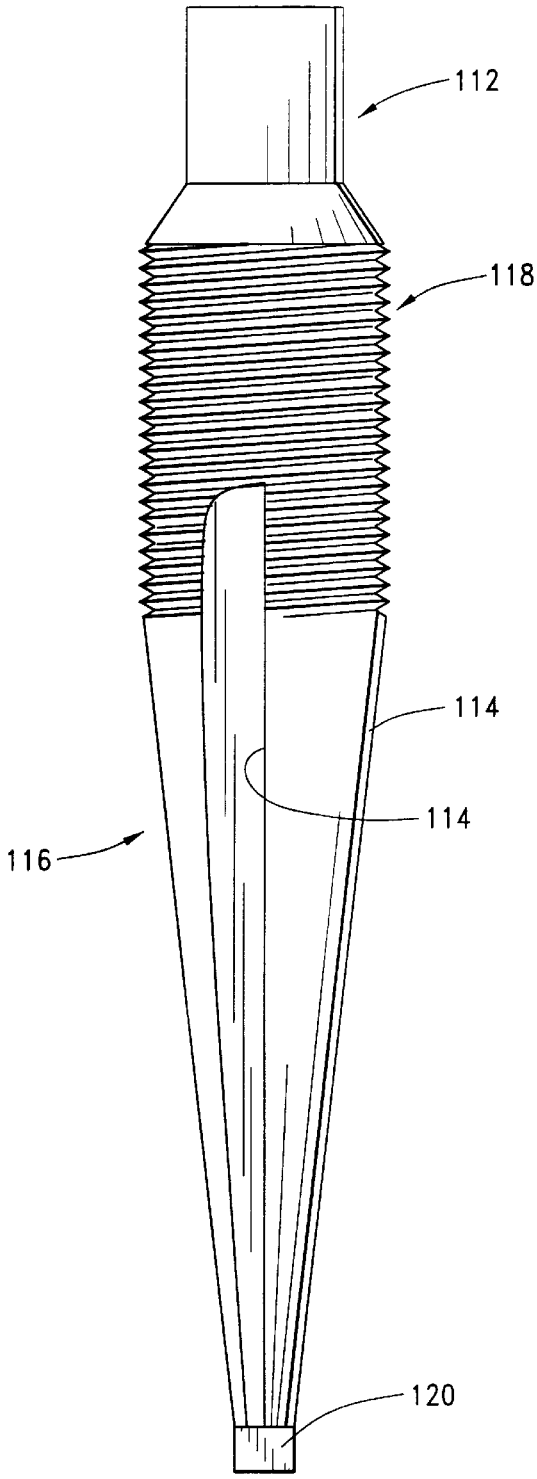
FIG. 14 is an elevational view of a further preferred embodiment of an inner engagement member of the present invention.
Figure 15:
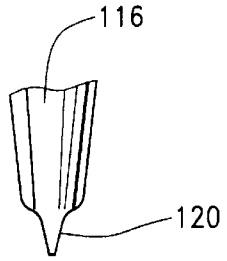
FIG. 15 is another elevational view of a chisel element at the tip of the inner engagement member shown in FIG. 14.

In the embodiment of FIG. 14, inner engagement member 112 includes longitudinally defined edges 114 formed in the conically tapered portion 116 and part of grooved or threaded cylindrical portion 118. These edges 114 can provide a reamer function when the member 112 is rotated in the lining material. The tapered portion 116 terminates at a tip including a chisel element 120 as shown in FIGS. 14 and 15. One use of a chisel tip is to punch through lining which has folded back on itself.

The tapered body configurations of FIGS. 12–15 are particularly suitable for navigating through a bent or collapsed lining segment. For example, such tools can be used to bore through lining that has collapsed or telescoped in on itself after being spiral cut by the previously described cutter tool. Such collapsing or telescoping can occur, for example, when the cutter is removed from the lining to enable a selected removal tool to be inserted into the lining.

Figure 16:
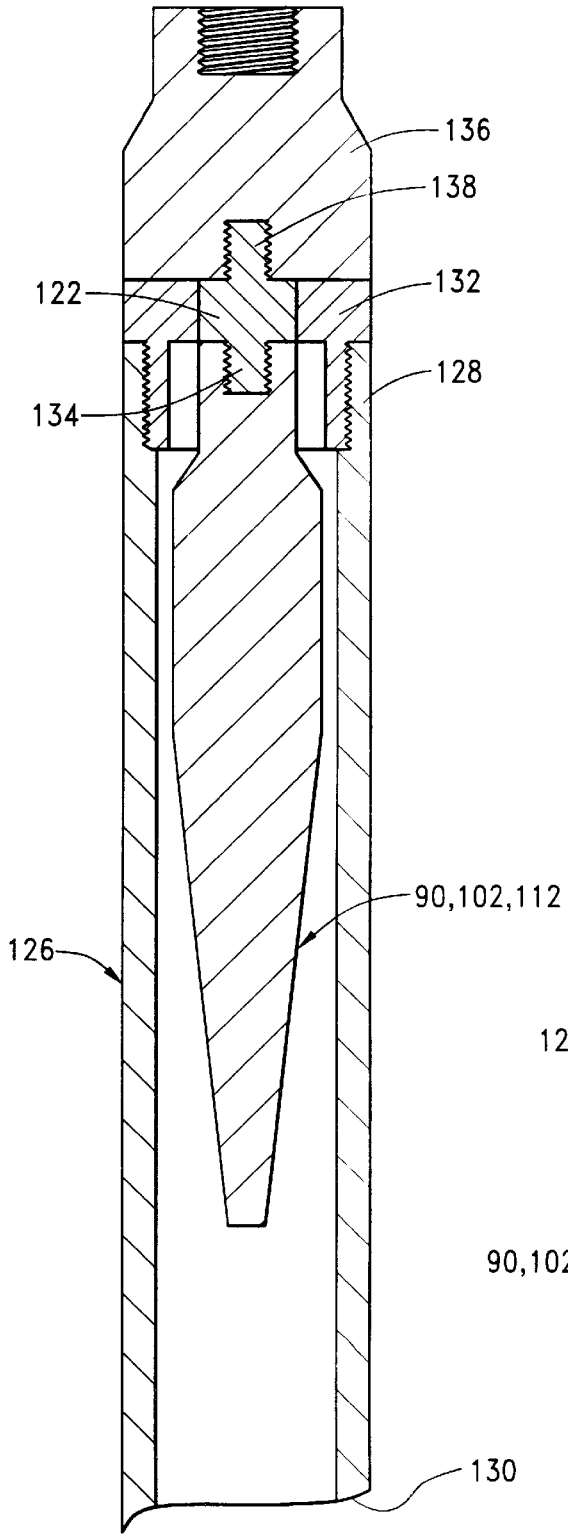
FIG. 16 is a sectioned elevational view of a preferred embodiment of a lining removal tool of the present invention.
Figure 17:
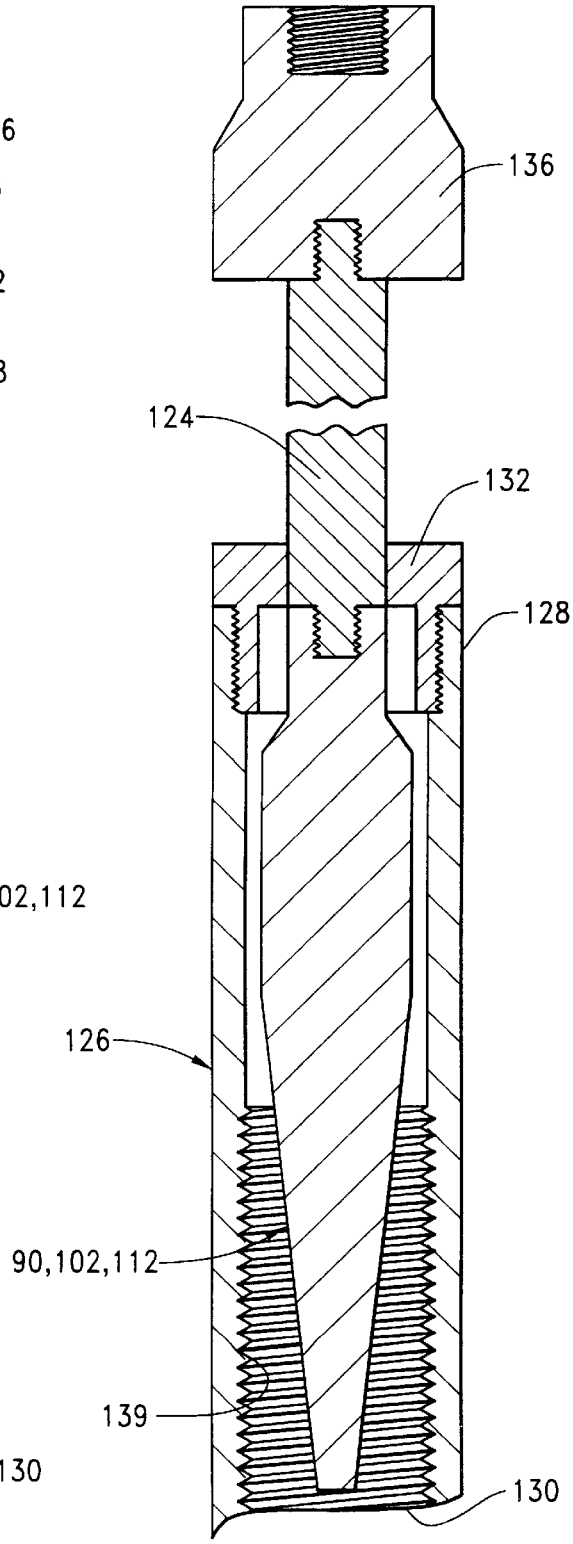
FIG. 17 is a sectioned elevational view of another preferred embodiment of a lining removal tool of the present invention.

Any of the aforementioned inner engagement members 90, 102, 112 can be used with the lining removal tools shown in FIGS. 16 and 17. Each attaches as described above for the tool of FIG. 12. In the lining removal tool of FIG. 16, attachment of the inner engagement member is to a hex-shaped (or other suitable non-circular shape) connector 122. In the lining removal tool of FIG. 17 attachment of the inner engagement member is to a hex-shaped (or other suitable non-circular shape) bar 124. Each of the connector 122 and the bar 124 defines part of a coupling connecting the inner engagement member in fixed rotational relation to an outer engagement member 126. The outer engagement member 126 is a cylindrical sleeve having an internally threaded upper end 128 (as oriented in the drawings) and a cutting lower end 130 (as oriented in the drawings). The lower end 130 is shown with a cut-lip configuration; however, other configurations can be used (e.g., circumferentially disposed teeth).

In the lining removal tool shown in FIG. 16, the coupling includes not only the inner connector 122 but also a cylindrical outer connector 132 which is threadedly connected to the upper end 128 of the outer engagement member 126. The outer connector 132 has a non-circular axial opening of complementary size and shape to the connector 122 (hex-shaped for the particular implementation-of the connector 122 described above). The height or thickness of the connector 122 in the embodiment of FIG. 16 is the same as the thickness of the adjacent wall of the connector 132 so that there is no axial movement of the connector 122 relative to the connector 132 when the inner engagement member is connected to lower threaded post 134 extending from connector 132 and when adapter 136 is connected to upper threaded post 138 as illustrated in FIG. 16. Rotational movement between the connectors 122, 132, and thus among other connected elements, is inhibited because of the nested non-circular configurations of the outer surface of the connector 122 and the aperture through the connector 132.

In the embodiment of FIG. 17, axial movement is permitted because the bar 124 is longer than the thickness of the upper wall of the outer connector 132. That is, the bar 124 having an outer shape complementary to and received in the non-circular hole of the outer connector 132 is slidable relative to the outer connector but is rotatable therewith, the bar 124 having a lower end connected to the respective inner engagement member. To use this tool, the bar 124 is connected to a suitable tool string, such as via adapter 136, which is moved into the well in known manner. When the lining 2 to be removed is encountered, the end 130 of the outer engagement member 126 typically abuts the outer perimeter of the lining. If lowering of the tool string continues, the bar 124 passes downwardly relative to the outer connector 132 and the member 126, carrying the depending inner engagement member with it. The illustrated tapered inner engagement member 90, 102 or 112 pushes through into the lining. The tool string is rotated, which simultaneously rotates both the inner and outer engagement members, thereby boring into the lining. The tool string is lifted, such as using known techniques, which moves the bar 124 and attached inner engagement member upwardly relative to the outer engagement member 126; this wedges lining material between the inner and outer engagement members. Further lifting of the tool string pulls the engaged lining out of the well.

In either the FIG. 16 or FIG. 17 embodiment, at least a portion of the inner surface of the outer engagement member 126 can be threaded or grooved to enhance the gripping engagement of the lining; however, this is illustrated only in FIG. 17 as identified by reference number 139.

Figure 19:
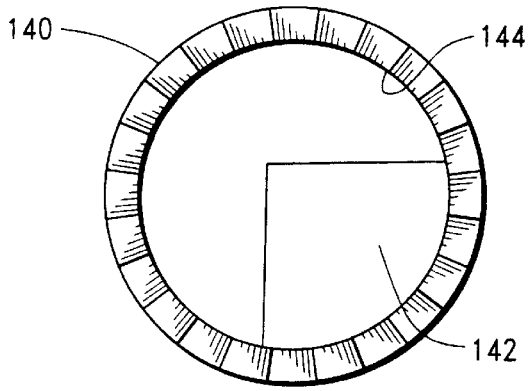
FIG. 19 is an end view of the integrated lining removal tool of FIG. 18
Figure 18:
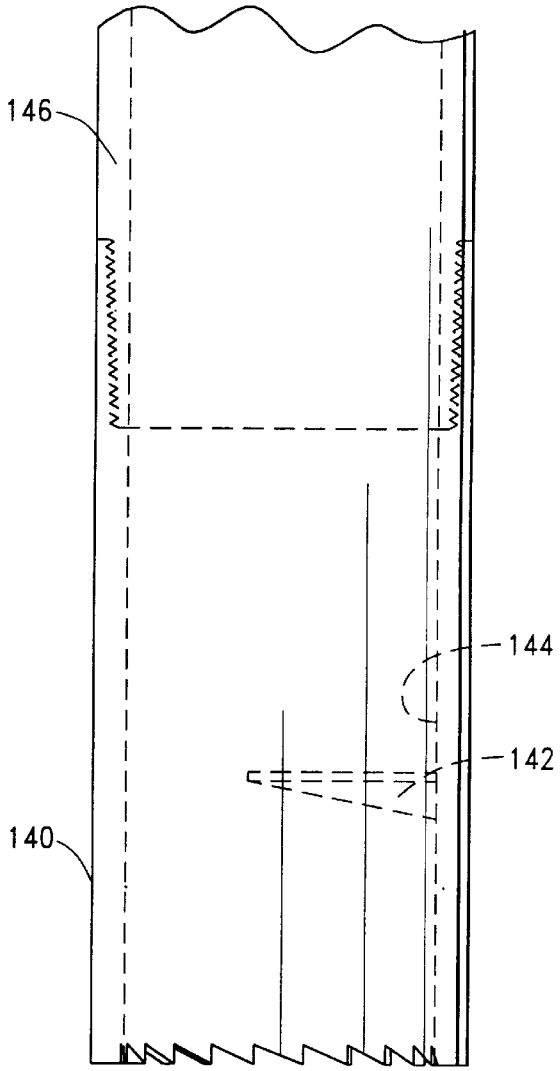
FIG. 18 is an elevational view of a preferred embodiment of an integrated lining removal tool of the present invention.

Referring next to FIGS. 18 and 19, another lining removal tool will be described. This embodiment includes an outer engagement member 140 and an inner engagement member 142 connected to an inner surface 144 of the outer engagement member 140. The outer engagement member 140 includes a cylindrical sleeve with cutting or milling teeth (or other cutting configuration) defined around the lower edge as in previous embodiments. This sleeve in a particular implementation is used as a wash pipe shoe or milling shoe threadedly connected to the lower end of a pipe 146 referred to as a wash pipe through which fluid can be pumped.

The inner engagement member 142 of the embodiment of FIGS. 18 and 19 includes a cutting member such as a substantially flat, triangularly or pie-shaped blade attached (e.g., welded) to the inner surface 144 of the outer engagement member 140. The blade has a substantially planar configuration extending substantially radially inwardly of the sleeve 140 from the inner surface 144 of the sleeve. This element can have various configurations and be disposed at various locations and angular dispositions within the outer engagement member; however, in one implementation the blade is positioned about one to two inches from the lower edge of the outer engagement member (as oriented in the drawings) and has a length of about two-thirds to one times the inner radius of the outer engagement member. Although only one inner engagement member is shown in FIGS. 18 and 19, more than one can be used. These preferably are axially spaced and circumferentially offset. Specific orientations and sizes can be determined in relation to the size of lining (e.g., its wall thickness) to be removed. The blade engages lining material when the pipe 146 and the connected outer engagement member 140 are rotated in lining in the well. The blade preferably has a configuration and disposition which cause cutting and upwardly directing or drawing in of lining material when the sleeve is rotated on the lining; this holds the lining so that it is pulled out of the tubing and the well when the sleeve and attached blade(s) are removed from the tubing and the well.

Figure 20:
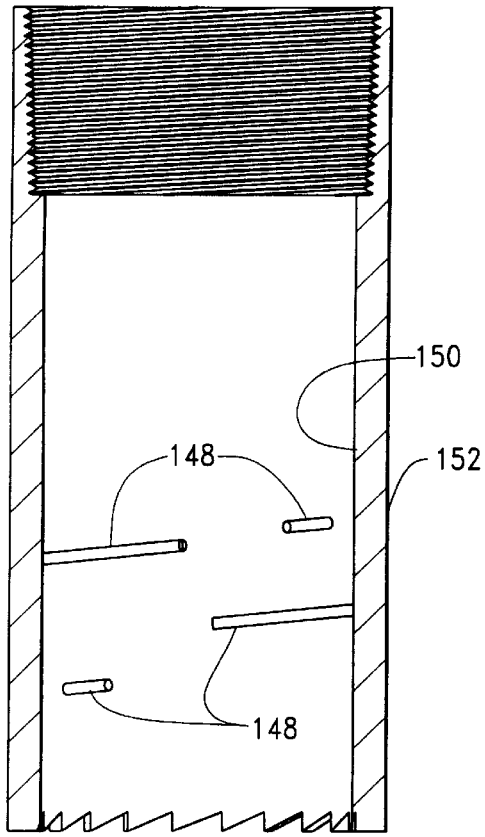
FIG. 20 is a sectioned elevational view of another preferred embodiment of an integrated lining removal tool of the present invention.

Another embodiment of a lining removal tool is shown in FIG. 20. This includes a plurality of wires 148 attached to inner surface 150 of outer engagement member 152. The illustrated implementation of this outer engagement member 152 includes a sleeve with a milling lower end as in the embodiment of FIGS. 18 and 19. The wires 148 of a particular implementation are resilient stiff braided wires welded to the inner surface of the sleeve of the member 152.

In use, the wires engage and hold lining material in response to lowering (and typically also rotating) the sleeve 152 in the lining material in the well. During this process, the free ends of the resilient wires 148 deform upwardly as they engage downhole material and then the force they apply due to their tendency to return to their original orientations holds the engaged lining material to enable extraction by pulling the tool from the well. Specific examples of a suitable material for the wires 148 are carbon steel slick wire and braided drilling line. A similar structure has been used in the prior art as a detector in fishing dropped implements from a well; when such an implement is encountered, the wires are bent upward, which upon withdrawal from the well and inspection indicates contact was made.

Regarding the other components described above for reaming, cutting and engaging, machine steel is one suitable material of construction. The individual components can be fabricated from such material using known cutting, boring, milling or other metal-work machining techniques applied to obtain the features described above or shown in the drawings for the particularly illustrated implementations.

Words of inclusion used herein, such as "comprise," "include," "has" and the like (and their variants) are not limiting with regard to other features being used with those features described herein.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of removing lining from a tubing in a well, comprising:

reaming at least a portion of material within the lining in the tubing in the well;

cutting at least a segment of the lining along a spiral path;

engaging the lining for applying a pulling force to the lining; and applying a pulling force to lift the engaged lining out of the tubing.

2. A lining reamer, comprising a reamer body having a forward end and a longitudinal passage defined through the reamer body to an opening at the forward end, the forward end including milling structure to mill plastic material of lining in a tubing in a well such that the milled plastic material forms a strand that passes into the opening and up the passage in the reamer body.

3. A lining reamer as defined in claim 2, wherein the reamer body further includes ports extending laterally from the longitudinal passage to provide exits to the outside of the reamer body when fluid is flowed through the longitudinal passage during reaming.

4. A lining reamer as defined in claim 3, wherein the reamer body includes a cylindrical body portion and a tapered body portion extending from the cylindrical body portion to the forward end.

5. A lining reamer as defined in claim 4, wherein the cylindrical body portion and the tapered body portion have a plurality of longitudinal reamer edges, wherein each of the edges is defined along a respective continuous longitudinal portion of both the cylindrical body portion and the tapered body portion.

6. A lining reamer as defined in claim 5, wherein the cylindrical body includes a coupling to receive a cutter ring.

7. A lining reamer as defined in claim 2, wherein the reamer body includes a cylindrical body portion and a tapered body portion extending from the cylindrical body portion to the forward end.

8. A lining reamer as defined in claim 7, wherein the cylindrical body portion and the tapered body portion have a plurality of longitudinal reamer edges, wherein each of the edges is defined along a respective continuous longitudinal portion of both the cylindrical body portion and the tapered body portion.

9. A lining reamer as defined in claim 8, wherein the cylindrical body includes a coupling to receive a cutter ring.

10. A lining reamer as defined in claim 2, wherein the reamer body further includes a coupling to receive a cutter ring.

11. A lining reamer as defined in claim 2, wherein the reamer body further includes a tapered body portion having the forward end.

12. Apparatus to excavate lining in a tubing in a well, comprising:

a reamer body having a forward end configured to enter lining in a tubing in a well; and a cutter ring releasably connected to the reamer body such that the cutter ring engages the lining radially of the reamer body when the forward end of the reamer body is in the lining.

13. Apparatus to excavate lining in a tubing in a well, comprising:

a reamer body having a forward end; and a cutter ring releasably connected to the reamer body;

wherein the reamer body includes a thread spaced from the forward end and wherein the cutter ring includes a thread defined therein to mate with the thread of the reamer body to thereby connect the cutter ring to the reamer body such that the cutter ring is spaced from the forward end.

14. Apparatus as defined in claim 13, wherein the forward end includes cutting elements defined therein.

15. Apparatus to excavate lining in a tubing in a well, comprising:

a reamer body having a forward end; and a cutter ring releasably connected to the reamer body;

wherein the reamer body includes a thread defined near an end thereof opposite the forward end and wherein the cutter ring includes a thread defined therein to mate with the thread of the reamer body to thereby connect the cutter ring to the reamer body.

16. Apparatus as defined in claim 15, wherein the cutter ring is a selected one of a plurality of cutter rings each having the same inner diameter and a thread defined therein to mate with the thread of the reamer body, but each having a different outer diameter.

17. Apparatus to excavate lining in a tubing in a well, comprising:

a reamer body having a forward end; and a cutter ring releasably connected to the reamer body;

wherein the cutter ring is a selected one of a plurality of cutter rings each having the same inner diameter such that each is releasably connectable to the reamer body, but each having a different outer diameter.

18. Apparatus to excavate lining in a tubing in a well, comprising:

a tapered reamer and mill body having a longitudinal passage defined therethrough; and a plurality of cutter rings having equivalent inner diameters such that any selected one of the cutter rings releasably connects to a threaded outer diameter of the reamer and mill body.

19. A method of excavating material of a lining in tubing in a well, comprising:

rotating circularly disposed inner cutting elements against a radially inwardly disposed annular portion of the material;

rotating circularly disposed outer cutting elements against a radially outwardly disposed annular portion of the material; and rotating reaming elements extending between the inner cutting elements and the outer cutting elements.

20. A method as defined in claim 19, wherein rotating circularly disposed inner cutting elements includes forming an axial strand of the material and wherein the method further comprises receiving the axial strand of material into an opening disposed inwardly relative to the inner cutting elements.

21. A method as defined in claim 20, further comprising flowing a fluid outwardly adjacent the reaming elements.

22. A method as defined in claim 19, further comprising flowing a fluid outwardly adjacent the reaming elements.

23. A cutting tool to cut lining in tubing in a well, comprising:

a blade carrier; and a cutter blade connected to the blade carrier, wherein the blade includes a cutting edge to cut into lining in tubing in a well and an angled surface disposed with the cutting edge such that interactive engagement between the lining and the angled surface during cutting by the cutting edge rotates the blade carrier relative to the lining.

24. A cutting tool as defined in claim 23, wherein the cutter blade includes:

a shank pivotally connected to the blade carrier; and a wedge extending from the shank such that the angled surface is defined between the shank and the wedge, wherein the wedge includes the cutting edge such that the wedge passes between the lining and the tubing as the cutting edge cuts the lining and the lining and angled surface interactively engage to rotate the blade carrier relative to the lining.

25. A cutting tool to cut lining in tubing in a well, comprising a cutter blade including a cutting edge to cut into lining in tubing in a well and further including an angled surface disposed with the cutting edge such that interactive engagement between the lining and the angled surface during cutting by the cutting edge rotates the cutter blade relative to the lining.

26. A cutting tool as defined in claim 25, wherein the cutter blade further includes:

a longitudinal shank; and a wedge extending laterally from the shank such that the angled surface is defined between the shank and the wedge, wherein the wedge includes the cutting edge such that the wedge passes between the lining and the tubing as the cutting edge cuts the lining and the lining and angled surface interactively engage to rotate the blade relative to the lining.

27. A cutting tool to cut lining in tubing in a well, comprising:

a mandrel;

a first sleeve disposed on the mandrel;

a second sleeve disposed on the mandrel and connected to the first sleeve such that the first and second sleeves can rotate relative to each other; and a cutter blade connected to the second sleeve.

28. A cutting tool as defined in claim 27, wherein the cutter blade includes a cutting edge to cut into lining in tubing in a well and further includes an angled surface disposed with the cutting edge such that interactive engagement between the lining and the angled surface during cutting by the cutting edge rotates the cutter blade relative to the lining.

29. A cutting tool as defined in claim 28, wherein the cutter blade further includes:

a longitudinal shank; and a wedge extending laterally from the shank such that the angled surface is defined between the shank and the wedge, wherein the wedge includes the cutting edge such that the wedge passes between the lining and the tubing as the cutting edge cuts the lining and the lining and angled surface interactively engage to rotate the blade relative to the lining.

30. A cutting tool as defined in claim 27, wherein the cutter blade includes a cutting edge to cut into lining in tubing in a well and an angled surface disposed with the cutting edge such that interactive engagement between the lining and the angled surface during cutting by the cutting edge rotates the cutting tool relative to the lining.

31. A cutting tool as defined in claim 30, wherein the cutter blade includes:

a shank pivotally connected to the second sleeve; and a wedge extending from the shank such that the angled surface is defined between the shank and the wedge, wherein the wedge includes the cutting edge such that the wedge passes between the lining and the tubing as the cutting edge cuts the lining and the lining and angled surface interactively engage to rotate the cutting tool relative to the lining.

32. A cutting tool as defined in claim 27, wherein the mandrel has a ramped groove defined therein receiving the cutter blade.

33. A cutting tool as defined in claim 32, wherein:

the cutting tool further comprises a plurality of stabilizers connected to the first sleeve such that the stabilizers engage the lining when the cutting tool is disposed therein; and the first sleeve has a slot defined therein receiving a pin extending from the mandrel.

34. A cutting tool as defined in claim 33, wherein the first and second sleeves include mating ends defining circular tracks having bearings disposed therein such that the second sleeve, the cutter blade connected thereto and received in the ramped groove of the mandrel, and the mandrel are rotatable relative to the first sleeve.

35. A cutting tool as defined in claim 34, wherein the cutter blade includes a cutting edge to cut into lining in tubing in a well and an angled surface disposed with the cutting edge such that interactive engagement between the lining and the angled surface during cutting by the cutting edge rotates the cutting tool relative to the lining.

36. A cutting tool as defined in claim 35, wherein the cutter blade includes:

a shank pivotally connected to the second sleeve; and a wedge extending from the shank such that the angled surface is defined between the shank and the wedge, wherein the wedge includes the cutting edge such that the wedge passes between the lining and the tubing as the cutting edge cuts the lining and the lining and angled surface interactively engage to rotate the cutting tool relative to the lining.

37. A cutting tool as defined in claim 27, wherein:

the cutting tool further comprises a plurality of stabilizers connected to the first sleeve such that the stabilizers engage the lining when the cutting tool is disposed therein; and the first sleeve has a slot defined therein receiving a pin extending from the mandrel.

38. A cutting tool as defined in claim 37, wherein the first and second sleeves include mating ends defining circular tracks having bearings disposed therein such that the second sleeve, the cutter blade connected thereto, and the mandrel are rotatable relative to the first sleeve.

39. A cutting tool as defined in claim 27, wherein the first and second sleeves include mating ends defining circular tracks having bearings disposed therein such that the second sleeve, the cutter blade connected thereto, and the mandrel are rotatable relative to the first sleeve.

40. A method of cutting lining in a tubing in a well, comprising:

lowering a cutter blade into a well having a lining in a tubing;

engaging the lining with the cutter blade; and moving the engaged cutter blade up the well such that a spiral cut is formed in the lining.

41. A method as defined in claim 40, wherein moving the engaged cutter blade up the well includes moving a cutting edge of the cutter blade to cut the lining and engaging a surface of the cutter blade with the cut lining to rotate the cutter blade relative to the lining as the cutter blade is moved up the well.

42. A method as defined in claim 41, wherein moving the engaged cutter blade up the well further includes passing a portion of the cutter blade between the lining and the tubing.

43. A method as defined in claim 40, wherein moving the engaged cutter blade up the well further includes passing a portion of the cutter blade between the lining and the tubing.

44. A lining removal tool, comprising:

an inner engagement member;

an outer engagement member; and a coupling connecting the inner and outer engagement members in fixed rotational relation to each other, wherein the coupling includes:

an outer connector threadedly connected to the outer engagement member and having a non-circular axial opening defined therethrough; and a bar having an outer shape complementary to and received in the non-circular hole of the outer connector such that the bar is slidable relative to the outer connector but is rotatable therewith, the bar having an end connected to the inner engagement member.

45. A lining removal tool, comprising:

an outer engagement member; and an inner engagement member connected to an inner surface of the outer engagement member, wherein the inner engagement member includes a pie-shaped blade welded to the inner surface of the outer engagement member.

46. A lining removal tool, comprising:

an outer engagement member; and an inner engagement member connected to an inner surface of the outer engagement member, wherein the inner engagement member includes a plurality of stiff wires attached to the inner surface of the outer engagement member.

47. A lining removal tool, comprising:

a sleeve including an end having a cutting edge defined therein to engage lining material in tubing in a well; and a blade connected to an inner surface of the sleeve such that the blade engages lining material when the sleeve is rotated in lining in the well.

48. A lining removal tool as defined in claim 47, wherein the blade has a substantially planar configuration extending substantially radially inwardly of the sleeve from the inner surface of the sleeve.

49. A lining removal tool as defined in claim 48, wherein the blade is connected to the inner surface within the range of about one to two inches from the end of the sleeve.

50. A lining removal tool as defined in claim 49, wherein the blade has a length within the range of about two-thirds to one times an inner radius of the sleeve.

51. A lining removal tool as defined in claim 47, wherein the blade has a configuration to cut and upwardly direct lining material when the sleeve is rotated in lining in the well.

52. A lining removal tool as defined in claim 51, wherein the blade has a length within the range of about two-thirds to one times an inner radius of the sleeve.

53. A lining removal tool as defined in claim 52, wherein the blade is connected to the inner surface within the range of about one to two inches from the end of the sleeve.

54. A lining removal tool as defined in claim 47, wherein the blade is connected to the inner surface within the range of about one to two inches from the end of the sleeve.

55. A lining removal tool as defined in claim 47, wherein the blade has a length within the range of about two-thirds to one times an inner radius of the sleeve.

56. A lining removal method, comprising:

rotating a sleeve on a plastic lining in tubing in a well;

cutting the plastic lining and drawing the cut plastic lining into the sleeve with a blade attached to an inner surface of the rotating sleeve; and removing the sleeve, blade and drawn in plastic lining from the tubing and the well.

57. A lining removal tool, comprising:

a sleeve including an end having a cutting edge defined therein to engage lining material in tubing in a well; and a plurality of wires connected to an inner surface of the sleeve such that the wires engage and hold lining material in response to rotating and lowering the sleeve in the lining material in the well.

58. A lining removal method, comprising:

rotating a sleeve on a plastic lining in tubing in a well;

gripping the plastic lining with resilient wires attached to an inner surface of the rotating sleeve; and removing the sleeve, wires and gripped plastic lining from the tubing and the well.

59. A removal tool, comprising:

a sleeve including an end having an edge defined therein for disposition adjacent material to be removed from a well; and a blade connected to an inner surface of the sleeve such that the blade engages the material when the sleeve is disposed adjacent the material and rotated in the well.

60. A removal tool as defined in claim 59, wherein the blade has a substantially planar configuration extending substantially radially inwardly of the sleeve from the inner surface of the sleeve.

61. A removal tool as defined in claim 59, wherein the blade has a configuration to cut and upwardly direct the material when the sleeve is rotated in the material in the well.

62. A removal tool as defined in claim 59, wherein the blade is connected to the inner surface within the range of about one to two inches from the end of the sleeve.

63. A removal tool as defined in claim 59, wherein the blade has a length within the range of about two-thirds to one times an inner radius of the sleeve.

64. A removal tool as defined in claim 60, wherein the blade is connected to the inner surface within the range of about one to two inches from the end of the sleeve.

65. A removal tool as defined in claim 64, wherein the blade has a length within the range of about two-thirds to one times an inner radius of the sleeve.

66. A removal tool as defined in claim 61, wherein the blade has a length within the range of about two-thirds to one times an inner radius of the sleeve.

67. A removal tool as defined in claim 66, wherein the blade is connected to the inner surface within the range of about one to two inches from the end of the sleeve.

68. A removal tool, comprising:

an inner engagement member;

an outer engagement member; and a coupling connecting the inner and outer engagement members in fixed rotational relation to each other, wherein the coupling includes a bar having an outer shape complementary to and received in a non-circular hole defined in fixed relationship with the outer engagement member such that the bar is slidable relative to the outer engagement member but is rotatable therewith, the bar having an end connected to the inner engagement member, wherein the inner engagement member is slidable relative to the outer engagement member but rotatable therewith such that the inner engagement member and the outer engagement member are operatively associated to engage material within a well and remove engaged material from the well.

* * * * *

UNITED STATES PATENT AND TRADEMARK OFFICE

CERTIFICATE OF CORRECTION

PATENT NO. : 6,578,635 B1
DATED : June 17, 2003
INVENTOR(S) : Charles D. Hailey

It is certified that error appears in the above-identified patent and that said Letters Patent is hereby corrected as shown below:

Column 10,
Line 33, delete the dash between “implementation” and “of.”
Line 43, after “among” and before “other,” insert -- the --.

Signed and Sealed this

Seventh Day of October, 2003

JAMES E. ROGAN
*Director of the United States Patent and Trademark Office*